US009024837B2

(12) United States Patent
Dokai et al.

(10) Patent No.: US 9,024,837 B2
(45) Date of Patent: May 5, 2015

(54) ANTENNA AND WIRELESS COMMUNICATION DEVICE

(75) Inventors: Yuya Dokai, Nagaokakyo (JP); Noboru Kato, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 245 days.

(21) Appl. No.: 13/613,021

(22) Filed: Sep. 13, 2012

(65) Prior Publication Data

US 2013/0002513 A1 Jan. 3, 2013

Related U.S. Application Data

(63) Continuation of application No. PCT/JP2011/053656, filed on Feb. 21, 2011.

(30) Foreign Application Priority Data

Mar. 31, 2010 (JP) ..... 2010-084008

(51) Int. Cl.

| | |
|---|---|
| ***H01Q 21/00*** | (2006.01) |
| ***H01Q 1/22*** | (2006.01) |
| ***H01Q 1/38*** | (2006.01) |
| ***H01Q 7/00*** | (2006.01) |
| ***H01Q 21/30*** | (2006.01) |
| ***H01Q 9/16*** | (2006.01) |

(52) U.S. Cl.

CPC ..... *H01Q 1/2208* (2013.01); *H01Q 1/38* (2013.01); *H01Q 7/00* (2013.01); *H01Q 21/30* (2013.01); *H01Q 1/2225* (2013.01); *H01Q 9/16* (2013.01)

(58) Field of Classification Search

USPC ..... 343/867, 742

See application file for complete search history.

(56) References Cited

U.S. PATENT DOCUMENTS

| | | | |
|---|---|---|---|
| 3,364,564 | A | 1/1968 | Kurtz et al. |
| 4,794,397 | A | 12/1988 | Ohe et al. |
| 5,232,765 | A | 8/1993 | Yano et al. |
| 5,253,969 | A | 10/1993 | Richert |

(Continued)

FOREIGN PATENT DOCUMENTS

| | | | |
|---|---|---|---|
| CA | 2 279 176 | A1 | 7/1998 |
| DE | 10 2006 057 369 | A1 | 6/2008 |

(Continued)

OTHER PUBLICATIONS

Official Communication issued in corresponding Japanese Patent Application No. 2012-508139, mailed on Jan. 7, 2014.

(Continued)

*Primary Examiner* — Tan Ho

(74) *Attorney, Agent, or Firm* — Keating & Bennett, LLP

(57) ABSTRACT

An antenna and a wireless communication device which are suitable for an RFID system and in which radiation characteristics are prevented from being changed as a result of impedance adjustment are configured such that the antenna includes a first loop electrode that has an external shape of a regular polygon or circle and that includes a pair of open ends, feeding portions arranged inside the first loop electrode, a second loop electrode connected to the feeding portions, and a coupling electrode that couples the first loop electrode and the second loop electrode to each other. The wireless communication device is obtained by coupling the wireless communication element which processes a high-frequency signal to the feeding portions.

19 Claims, 3 Drawing Sheets

(56) References Cited

U.S. PATENT DOCUMENTS 5,337,063 A 8/1994 Takahira
5,374,937 A 12/1994 Tsunekawa et al.
5,399,060 A 3/1995 Richert
5,491,483 A 2/1996 D'Hont
5,528,222 A 6/1996 Moskowitz et al.
5,757,074 A 5/1998 Matloubian et al.
5,854,480 A 12/1998 Noto
5,903,239 A 5/1999 Takahashi et al.
5,936,150 A 8/1999 Kobrin et al.
5,955,723 A 9/1999 Reiner
5,995,006 A 11/1999 Walsh
6,104,311 A 8/2000 Lastinger
6,107,920 A 8/2000 Eberhardt et al.
6,172,608 B1 1/2001 Cole
6,181,287 B1 1/2001 Beigel
6,190,942 B1 2/2001 Wilm et al.
6,243,045 B1 6/2001 Ishibashi
6,249,258 B1 6/2001 Bloch et al.
6,259,369 B1 7/2001 Monico
6,271,803 B1 8/2001 Watanabe et al.
6,335,686 B1 1/2002 Goff et al.
6,362,784 B1 3/2002 Kane et al.
6,367,143 B1 4/2002 Sugimura
6,378,774 B1 4/2002 Emori et al.
6,406,990 B1 6/2002 Kawai
6,448,874 B1 9/2002 Shiino et al.
6,452,563 B1 9/2002 Porte
6,462,716 B1 10/2002 Kushihi
6,542,050 B1 4/2003 Arai et al.
6,573,874 B1 6/2003 Saito et al.
6,600,459 B2 7/2003 Yokoshima et al.
6,634,564 B2 10/2003 Kuramochi
6,664,645 B2 12/2003 Kawai
6,763,254 B2 7/2004 Nishikawa
6,812,707 B2 11/2004 Yonezawa et al.
6,828,881 B2 12/2004 Mizutani et al.
6,837,438 B1 1/2005 Takasugi et al.
6,861,731 B2 3/2005 Buijsman et al.
6,927,738 B2 8/2005 Senba et al.
6,956,481 B1 10/2005 Cole
6,963,729 B2 11/2005 Uozumi
7,088,249 B2 8/2006 Senba et al.
7,088,307 B2 8/2006 Imaizumi
7,112,952 B2 9/2006 Arai et al.
7,119,693 B1 10/2006 Devilbiss
7,129,834 B2 10/2006 Naruse et al.
7,248,221 B2 7/2007 Kai et al.
7,250,910 B2 7/2007 Yoshikawa et al.
7,276,929 B2 10/2007 Arai et al.
7,317,396 B2 1/2008 Ujino
7,405,664 B2 7/2008 Sakama et al.
7,446,729 B2 * 11/2008 Maruyama et al. ..... 343/867
8,344,950 B2 * 1/2013 Su ..... 343/700 MS
8,378,917 B2 * 2/2013 Yoneda et al. ..... 343/867
2001/0011012 A1 8/2001 Hino et al.
2002/0011967 A1 1/2002 Goff et al.
2002/0015002 A1 2/2002 Yasukawa et al.
2002/0044092 A1 4/2002 Kushihi
2002/0067316 A1 6/2002 Yokoshima et al.
2002/0093457 A1 7/2002 Hamada et al.
2002/0186004 A1 12/2002 Prazeres da Costa et al.
2003/0006901 A1 1/2003 Kim et al.
2003/0020661 A1 1/2003 Sato
2003/0045324 A1 3/2003 Nagumo et al.
2003/0169153 A1 9/2003 Muller
2003/0206095 A1 11/2003 Chaloner et al.
2004/0001027 A1 1/2004 Killen et al.
2004/0026519 A1 2/2004 Usami et al.
2004/0056823 A1 3/2004 Zuk et al.
2004/0066617 A1 4/2004 Hirabayashi et al.
2004/0217915 A1 11/2004 Imaizumi
2004/0219956 A1 11/2004 Iwai et al.
2004/0227673 A1 11/2004 Iwai et al.
2004/0252064 A1 12/2004 Yuanzhu
2005/0001031 A1 1/2005 Akiho et al.
2005/0007296 A1 1/2005 Endo et al.
2005/0092836 A1 5/2005 Kudo
2005/0099337 A1 5/2005 Takei et al.
2005/0125093 A1 6/2005 Kikuchi et al.
2005/0133605 A1 6/2005 Koyama et al.
2005/0134460 A1 6/2005 Usami
2005/0134506 A1 6/2005 Egbert
2005/0138798 A1 6/2005 Sakama et al.
2005/0140512 A1 6/2005 Sakama et al.
2005/0162331 A1 7/2005 Endo et al.
2005/0232412 A1 10/2005 Ichihara et al.
2005/0236623 A1 10/2005 Takechi et al.
2005/0253726 A1 11/2005 Yoshida et al.
2005/0275539 A1 12/2005 Sakama et al.
2006/0001138 A1 1/2006 Sakama et al.
2006/0032926 A1 2/2006 Baba et al.
2006/0044192 A1 3/2006 Egbert
2006/0055531 A1 3/2006 Cook et al.
2006/0055601 A1 3/2006 Kameda et al.
2006/0071084 A1 4/2006 Detig et al.
2006/0109185 A1 5/2006 Iwai et al.
2006/0114159 A1 6/2006 Yoshikawa et al.
2006/0145872 A1 7/2006 Tanaka et al.
2006/0158380 A1 7/2006 Son et al.
2006/0170606 A1 8/2006 Yamagajo et al.
2006/0208900 A1 9/2006 Tavassoli Hozouri
2006/0214801 A1 9/2006 Murofushi et al.
2006/0220871 A1 10/2006 Baba et al.
2006/0244568 A1 11/2006 Tong et al.
2006/0244676 A1 11/2006 Uesaka
2006/0267138 A1 11/2006 Kobayashi
2007/0004028 A1 1/2007 Lair et al.
2007/0015549 A1 1/2007 Hernandez et al.
2007/0018893 A1 1/2007 Kai et al.
2007/0040028 A1 2/2007 Kawamata
2007/0052613 A1 3/2007 Gallschuetz et al.
2007/0057854 A1 3/2007 Oodachi et al.
2007/0069037 A1 3/2007 Kawai
2007/0122960 A1 5/2007 Aoki
2007/0132591 A1 6/2007 Khatri
2007/0164414 A1 7/2007 Dokai et al.
2007/0200705 A1 8/2007 Yamagajo et al.
2007/0200782 A1 8/2007 Hayama et al.
2007/0229276 A1 10/2007 Yamagajo et al.
2007/0247387 A1 10/2007 Kubo et al.
2007/0252700 A1 11/2007 Ishihara et al.
2007/0252703 A1 11/2007 Kato et al.
2007/0252763 A1 11/2007 Martin
2007/0252770 A1 11/2007 Kai et al.
2007/0285335 A1 12/2007 Bungo et al.
2007/0290928 A1 12/2007 Chang et al.
2008/0024156 A1 1/2008 Arai et al.
2008/0068132 A1 3/2008 Kayanakis et al.
2008/0070003 A1 3/2008 Nakatani et al.
2008/0074268 A1 3/2008 Shafer
2008/0087990 A1 4/2008 Kato et al.
2008/0111695 A1 5/2008 Yamagajo et al.
2008/0129606 A1 6/2008 Yanagisawa et al.
2008/0143630 A1 6/2008 Kato et al.
2008/0169905 A1 7/2008 Slatter
2008/0184281 A1 7/2008 Ashizaki et al.
2008/0252551 A1 10/2008 Kubo et al.
2008/0272885 A1 11/2008 Atherton
2009/0002130 A1 1/2009 Kato
2009/0008460 A1 1/2009 Kato
2009/0009007 A1 1/2009 Kato et al.
2009/0021352 A1 1/2009 Kataya et al.
2009/0021446 A1 1/2009 Kataya et al.
2009/0065594 A1 3/2009 Kato et al.
2009/0066466 A1 3/2009 Arimura
2009/0080296 A1 3/2009 Dokai et al.
2009/0096696 A1 4/2009 Joyce, Jr. et al.
2009/0109034 A1 4/2009 Chen et al.
2009/0109102 A1 4/2009 Dokai et al.
2009/0134979 A1 5/2009 Tsukamoto et al.
2009/0140947 A1 6/2009 Sasagawa et al.
2009/0160719 A1 6/2009 Kato et al.
2009/0201116 A1 8/2009 Orihara
2009/0224061 A1 9/2009 Kato et al.

(56) References Cited

U.S. PATENT DOCUMENTS

| | | | |
|---|---|---|---|
| 2009/0231106 | A1 | 9/2009 | Okamura |
| 2009/0262041 | A1 | 10/2009 | Ikemoto et al. |
| 2009/0266900 | A1 | 10/2009 | Ikemoto et al. |
| 2009/0278687 | A1 | 11/2009 | Kato |
| 2009/0284220 | A1 | 11/2009 | Toncich et al. |
| 2009/0321527 | A1 | 12/2009 | Kato et al. |
| 2010/0103058 | A1 | 4/2010 | Kato et al. |
| 2010/0182210 | A1 | 7/2010 | Ryou et al. |
| 2010/0230499 | A1 | 9/2010 | Choo et al. |
| 2010/0283694 | A1 | 11/2010 | Kato |
| 2010/0308118 | A1 | 12/2010 | Kataya et al. |
| 2011/0031320 | A1 | 2/2011 | Kato et al. |
| 2011/0063184 | A1 | 3/2011 | Furumura et al. |
| 2011/0080331 | A1 | 4/2011 | Kato |
| 2011/0186641 | A1 | 8/2011 | Kato et al. |
| 2011/0253795 | A1 | 10/2011 | Kato |
| 2012/0001701 | A1 | 1/2012 | Taniguchi et al. |

FOREIGN PATENT DOCUMENTS

| | | | |
|---|---|---|---|
| EP | 0 694 874 | A2 | 1/1996 |
| EP | 0 848 448 | A2 | 6/1998 |
| EP | 0 948 083 | A2 | 10/1999 |
| EP | 0 977 145 | A2 | 2/2000 |
| EP | 1 010 543 | A1 | 6/2000 |
| EP | 1 085 480 | A1 | 3/2001 |
| EP | 1 160 915 | A2 | 12/2001 |
| EP | 1 170 795 | A2 | 1/2002 |
| EP | 1 193 793 | A2 | 4/2002 |
| EP | 1 227 540 | A1 | 7/2002 |
| EP | 1 280 232 | A1 | 1/2003 |
| EP | 1 280 350 | A1 | 1/2003 |
| EP | 1 343 223 | A1 | 9/2003 |
| EP | 1 357 511 | A2 | 10/2003 |
| EP | 1 547 753 | A1 | 6/2005 |
| EP | 1 548 872 | A1 | 6/2005 |
| EP | 1 626 364 | A2 | 2/2006 |
| EP | 1 701 296 | A1 | 9/2006 |
| EP | 1 703 589 | A1 | 9/2006 |
| EP | 1 742 296 | A1 | 1/2007 |
| EP | 1 744 398 | A1 | 1/2007 |
| EP | 1 840 802 | A1 | 10/2007 |
| EP | 1 841 005 | A1 | 10/2007 |
| EP | 1 865 574 | A1 | 12/2007 |
| EP | 1 887 652 | A1 | 2/2008 |
| EP | 1 976 056 | A1 | 10/2008 |
| EP | 1 988 491 | A1 | 11/2008 |
| EP | 1 988 601 | A1 | 11/2008 |
| EP | 1 993 170 | A1 | 11/2008 |
| EP | 2 009 738 | A1 | 12/2008 |
| EP | 2 012 258 | A1 | 1/2009 |
| EP | 2 096 709 | A1 | 9/2009 |
| EP | 2 148 449 | A1 | 1/2010 |
| EP | 2 166 617 | A1 | 3/2010 |
| EP | 2 251 934 | A1 | 11/2010 |
| EP | 2 256 861 | A1 | 12/2010 |
| EP | 2 330 684 | A1 | 6/2011 |
| GB | 2 305 075 | A | 3/1997 |
| GB | 2461443 | A | 1/2010 |
| GB | 2470299 | A | 11/2010 |
| JP | 50-143451 | A | 11/1975 |
| JP | 61-284102 | A | 12/1986 |
| JP | 62-127140 | U | 8/1987 |
| JP | 01-212035 | A | 8/1989 |
| JP | 02-164105 | A | 6/1990 |
| JP | 02-256208 | A | 10/1990 |
| JP | 3-171385 | A | 7/1991 |
| JP | 03-503467 | A | 8/1991 |
| JP | 03-262313 | A | 11/1991 |
| JP | 04-150011 | A | 5/1992 |
| JP | 04-167500 | A | 6/1992 |
| JP | 04-096814 | U | 8/1992 |
| JP | 04-101168 | U | 9/1992 |
| JP | 04-134807 | U | 12/1992 |
| JP | 5-41610 | A | 2/1993 |
| JP | 05-226926 | A | 9/1993 |
| JP | 05-327331 | A | 12/1993 |
| JP | 6-53733 | A | 2/1994 |
| JP | 06-077729 | A | 3/1994 |
| JP | 06-029215 | U | 4/1994 |
| JP | 06-177635 | A | 6/1994 |
| JP | 6-260949 | A | 9/1994 |
| JP | 07-183836 | A | 7/1995 |
| JP | 08-055725 | A | 2/1996 |
| JP | 08-056113 | A | 2/1996 |
| JP | 8-87580 | A | 4/1996 |
| JP | 08-88586 | A | 4/1996 |
| JP | 08-088586 | A | 4/1996 |
| JP | 08-176421 | A | 7/1996 |
| JP | 08-180160 | A | 7/1996 |
| JP | 08-279027 | A | 10/1996 |
| JP | 08-307126 | A | 11/1996 |
| JP | 08-330372 | A | 12/1996 |
| JP | 09-014150 | A | 1/1997 |
| JP | 09-035025 | A | 2/1997 |
| JP | 09-093029 | A | 4/1997 |
| JP | 9-93029 | A | 4/1997 |
| JP | 09-245381 | A | 9/1997 |
| JP | 09-252217 | A | 9/1997 |
| JP | 09-270623 | A | 10/1997 |
| JP | 09-284038 | A | 10/1997 |
| JP | 09-294374 | A | 11/1997 |
| JP | 9-512367 | A | 12/1997 |
| JP | 10-69533 | A | 3/1998 |
| JP | 10-069533 | A | 3/1998 |
| JP | 10-084406 | A | 3/1998 |
| JP | 10-505466 | A | 5/1998 |
| JP | 10-171954 | A | 6/1998 |
| JP | 10-173427 | A | 6/1998 |
| JP | 10-193849 | A | 7/1998 |
| JP | 10-193851 | A | 7/1998 |
| JP | 10-242742 | A | 9/1998 |
| JP | 10-293828 | A | 11/1998 |
| JP | 10-334203 | A | 12/1998 |
| JP | 2834584 | B2 | 12/1998 |
| JP | 11-025244 | A | 1/1999 |
| JP | 11-039441 | A | 2/1999 |
| JP | 11-075329 | A | 3/1999 |
| JP | 11-085937 | A | 3/1999 |
| JP | 11-88241 | A | 3/1999 |
| JP | 11-102424 | A | 4/1999 |
| JP | 11-103209 | A | 4/1999 |
| JP | 11-149536 | A | 6/1999 |
| JP | 11-149537 | A | 6/1999 |
| JP | 11-149538 | A | 6/1999 |
| JP | 11-175678 | A | 7/1999 |
| JP | 11-219420 | A | 8/1999 |
| JP | 11-220319 | A | 8/1999 |
| JP | 11-282993 | A | 10/1999 |
| JP | 11-328352 | A | 11/1999 |
| JP | 11-331014 | A | 11/1999 |
| JP | 11-346114 | A | 12/1999 |
| JP | 11-355030 | A | 12/1999 |
| JP | 11-515094 | A | 12/1999 |
| JP | 2000-21128 | A | 1/2000 |
| JP | 2000-021639 | A | 1/2000 |
| JP | 2000-022421 | A | 1/2000 |
| JP | 2000-048152 | A | 2/2000 |
| JP | 2000-059260 | A | 2/2000 |
| JP | 2000-085283 | A | 3/2000 |
| JP | 2000-090207 | A | 3/2000 |
| JP | 2000-132643 | A | 5/2000 |
| JP | 2000-137778 | A | 5/2000 |
| JP | 2000-137779 | A | 5/2000 |
| JP | 2000-137785 | A | 5/2000 |
| JP | 2000-148948 | A | 5/2000 |
| JP | 2000-172812 | A | 6/2000 |
| JP | 2000-209013 | A | 7/2000 |
| JP | 2000-222540 | A | 8/2000 |
| JP | 2000-510271 | A | 8/2000 |
| JP | 2000-242754 | A | 9/2000 |
| JP | 2000-243797 | A | 9/2000 |
| JP | 2000-251049 | A | 9/2000 |

(56) References Cited

FOREIGN PATENT DOCUMENTS

| | | | |
|---|---|---|---|
| JP | 2000-261230 | A | 9/2000 |
| JP | 2000-276569 | A | 10/2000 |
| JP | 2000-286634 | A | 10/2000 |
| JP | 2000-286760 | A | 10/2000 |
| JP | 2000-311226 | A | 11/2000 |
| JP | 2000-321984 | A | 11/2000 |
| JP | 2000-349680 | A | 12/2000 |
| JP | 2001-10264 | A | 1/2001 |
| JP | 2001-028036 | A | 1/2001 |
| JP | 2001-043340 | A | 2/2001 |
| JP | 3075400 | U | 2/2001 |
| JP | 2001-66990 | A | 3/2001 |
| JP | 2001-76111 | A | 3/2001 |
| JP | 2001-084463 | A | 3/2001 |
| JP | 2001-101369 | A | 4/2001 |
| JP | 2001-505682 | A | 4/2001 |
| JP | 2001-168628 | A | 6/2001 |
| JP | 2001-188890 | A | 7/2001 |
| JP | 2001-209767 | A | 8/2001 |
| JP | 2001-240046 | A | 9/2001 |
| JP | 2001-240217 | A | 9/2001 |
| JP | 2001-256457 | A | 9/2001 |
| JP | 2001-257292 | A | 9/2001 |
| JP | 2001-514777 | A | 9/2001 |
| JP | 2001-291181 | A | 10/2001 |
| JP | 2001-319380 | A | 11/2001 |
| JP | 2001-331976 | A | 11/2001 |
| JP | 2001-332923 | A | 11/2001 |
| JP | 2001-339226 | A | 12/2001 |
| JP | 2001-344574 | A | 12/2001 |
| JP | 2001-351083 | A | 12/2001 |
| JP | 2001-351084 | A | 12/2001 |
| JP | 2001-352176 | A | 12/2001 |
| JP | 2001-358527 | A | 12/2001 |
| JP | 2002-024776 | A | 1/2002 |
| JP | 2002-026513 | A | 1/2002 |
| JP | 2002-32731 | A | 1/2002 |
| JP | 2002-042076 | A | 2/2002 |
| JP | 2002-042083 | A | 2/2002 |
| JP | 2002-063557 | A | 2/2002 |
| JP | 2002-505645 | A | 2/2002 |
| JP | 2002-76750 | A | 3/2002 |
| JP | 2002-076750 | A | 3/2002 |
| JP | 2002-111363 | A | 4/2002 |
| JP | 2002-143826 | A | 5/2002 |
| JP | 2002-150245 | A | 5/2002 |
| JP | 2002-157564 | A | 5/2002 |
| JP | 2002-158529 | A | 5/2002 |
| JP | 2002-175508 | A | 6/2002 |
| JP | 2002-175920 | A | 6/2002 |
| JP | 2002-183676 | A | 6/2002 |
| JP | 2002-183690 | A | 6/2002 |
| JP | 2002-185358 | A | 6/2002 |
| JP | 2002-204117 | A | 7/2002 |
| JP | 2002-521757 | A | 7/2002 |
| JP | 2002-522849 | A | 7/2002 |
| JP | 2002-222398 | A | 8/2002 |
| JP | 2002-230128 | A | 8/2002 |
| JP | 2002-232221 | A | 8/2002 |
| JP | 2002-245416 | A | 8/2002 |
| JP | 2002-246828 | A | 8/2002 |
| JP | 2002-252117 | A | 9/2002 |
| JP | 2002-259934 | A | 9/2002 |
| JP | 2002-280821 | A | 9/2002 |
| JP | 2002-290130 | A | 10/2002 |
| JP | 2002-298109 | A | 10/2002 |
| JP | 2002-308437 | A | 10/2002 |
| JP | 2002-319008 | A | 10/2002 |
| JP | 2002-319009 | A | 10/2002 |
| JP | 2002-319812 | A | 10/2002 |
| JP | 2002-324221 | A | 11/2002 |
| JP | 2002-325013 | A | 11/2002 |
| JP | 2002-362613 | A | 12/2002 |
| JP | 2002-366917 | A | 12/2002 |
| JP | 2002-373029 | A | 12/2002 |
| JP | 2002-373323 | A | 12/2002 |
| JP | 2002-374139 | A | 12/2002 |
| JP | 2003-006599 | A | 1/2003 |
| JP | 2003-016412 | A | 1/2003 |
| JP | 2003-022912 | A | 1/2003 |
| JP | 2003-026177 | A | 1/2003 |
| JP | 2003-030612 | A | 1/2003 |
| JP | 2003-037861 | A | 2/2003 |
| JP | 2003-44789 | A | 2/2003 |
| JP | 2003-046318 | A | 2/2003 |
| JP | 2003-58840 | A | 2/2003 |
| JP | 2003-067711 | A | 3/2003 |
| JP | 2003-069335 | A | 3/2003 |
| JP | 2003-076947 | A | 3/2003 |
| JP | 2003-76963 | A | 3/2003 |
| JP | 2003-78333 | A | 3/2003 |
| JP | 2003-078336 | A | 3/2003 |
| JP | 2003-085501 | A | 3/2003 |
| JP | 2003-085520 | A | 3/2003 |
| JP | 2003-87008 | A | 3/2003 |
| JP | 2003-87044 | A | 3/2003 |
| JP | 2003-099184 | A | 4/2003 |
| JP | 2003-099720 | A | 4/2003 |
| JP | 2003-099721 | A | 4/2003 |
| JP | 2003-108966 | A | 4/2003 |
| JP | 2003-110344 | A | 4/2003 |
| JP | 2003-132330 | A | 5/2003 |
| JP | 2003-134007 | A | 5/2003 |
| JP | 2003-139866 | A | 5/2003 |
| JP | 2003-155062 | A | 5/2003 |
| JP | 2003-158414 | A | 5/2003 |
| JP | 2003-168760 | A | 6/2003 |
| JP | 2003-179565 | A | 6/2003 |
| JP | 2003-187207 | A | 7/2003 |
| JP | 2003-187211 | A | 7/2003 |
| JP | 2003-188338 | A | 7/2003 |
| JP | 2003-188620 | A | 7/2003 |
| JP | 2003-198230 | A | 7/2003 |
| JP | 2003-209421 | A | 7/2003 |
| JP | 2003-216919 | A | 7/2003 |
| JP | 2003-218624 | A | 7/2003 |
| JP | 2003-233780 | A | 8/2003 |
| JP | 2003-242471 | A | 8/2003 |
| JP | 2003-243918 | A | 8/2003 |
| JP | 2003-249813 | A | 9/2003 |
| JP | 2003-529163 | A | 9/2003 |
| JP | 2003-288560 | A | 10/2003 |
| JP | 2003-308363 | A | 10/2003 |
| JP | 2003-309418 | A | 10/2003 |
| JP | 2003-317055 | A | 11/2003 |
| JP | 2003-317060 | A | 11/2003 |
| JP | 2003-331246 | A | 11/2003 |
| JP | 2003-332820 | A | 11/2003 |
| JP | 2003-536302 | A | 12/2003 |
| JP | 2004-040597 | A | 2/2004 |
| JP | 2004-505481 | A | 2/2004 |
| JP | 2004-082775 | A | 3/2004 |
| JP | 2004-88218 | A | 3/2004 |
| JP | 2004-93693 | A | 3/2004 |
| JP | 2004-096566 | A | 3/2004 |
| JP | 2004-096618 | A | 3/2004 |
| JP | 2004-506905 | A | 3/2004 |
| JP | 2004-104344 | A | 4/2004 |
| JP | 2004-121412 | A | 4/2004 |
| JP | 2004-126750 | A | 4/2004 |
| JP | 2004-127230 | A | 4/2004 |
| JP | 2004-140513 | A | 5/2004 |
| JP | 2004-145449 | A | 5/2004 |
| JP | 2004-163134 | A | 6/2004 |
| JP | 2004-166175 | A | 6/2004 |
| JP | 2004-166176 | A | 6/2004 |
| JP | 2004-172919 | A | 6/2004 |
| JP | 2004-213582 | A | 7/2004 |
| JP | 2004-519916 | A | 7/2004 |
| JP | 2004/070879 | A | 8/2004 |
| JP | 2004-234595 | A | 8/2004 |
| JP | 2004-253858 | A | 9/2004 |
| JP | 2004-527864 | A | 9/2004 |
| JP | 2004-280390 | A | 10/2004 |

(56) References Cited

FOREIGN PATENT DOCUMENTS

| | | | |
|---|---|---|---|
| JP | 2004-282403 | A | 10/2004 |
| JP | 2004-287767 | A | 10/2004 |
| JP | 2004-295297 | A | 10/2004 |
| JP | 2004-297249 | A | 10/2004 |
| JP | 2004-297681 | A | 10/2004 |
| JP | 2004-304370 | A | 10/2004 |
| JP | 2004-319848 | A | 11/2004 |
| JP | 2004-326380 | A | 11/2004 |
| JP | 2004-334268 | A | 11/2004 |
| JP | 2004-336250 | A | 11/2004 |
| JP | 2004-336604 | A | 11/2004 |
| JP | 2004-343000 | A | 12/2004 |
| JP | 2004-362190 | A | 12/2004 |
| JP | 2004-362341 | A | 12/2004 |
| JP | 2004-362602 | A | 12/2004 |
| JP | 2005-5866 | A | 1/2005 |
| JP | 2005-006096 | A | 1/2005 |
| JP | 2005-18156 | A | 1/2005 |
| JP | 2005-033461 | A | 2/2005 |
| JP | 2005-050581 | A | 2/2005 |
| JP | 2005-064799 | A | 3/2005 |
| JP | 2005-124061 | A | 5/2005 |
| JP | 2005-128592 | A | 5/2005 |
| JP | 2005-129019 | A | 5/2005 |
| JP | 2005-134942 | A | 5/2005 |
| JP | 2005-135132 | A | 5/2005 |
| JP | 2005-136528 | A | 5/2005 |
| JP | 2005-137032 | A | 5/2005 |
| JP | 3653099 | B2 | 5/2005 |
| JP | 2005-165839 | A | 6/2005 |
| JP | 2005-167327 | A | 6/2005 |
| JP | 2005-167813 | A | 6/2005 |
| JP | 2005-190417 | A | 7/2005 |
| JP | 2005-191705 | A | 7/2005 |
| JP | 2005-192124 | A | 7/2005 |
| JP | 2005-202943 | A | 7/2005 |
| JP | 2005-204038 | A | 7/2005 |
| JP | 2005-210223 | A | 8/2005 |
| JP | 2005-210676 | A | 8/2005 |
| JP | 2005-210680 | A | 8/2005 |
| JP | 2005-217822 | A | 8/2005 |
| JP | 2005-229474 | A | 8/2005 |
| JP | 2005-236339 | A | 9/2005 |
| JP | 2005-244778 | A | 9/2005 |
| JP | 2005-252853 | A | 9/2005 |
| JP | 2005-275870 | A | 10/2005 |
| JP | 2005-277579 | A | 10/2005 |
| JP | 2005-284352 | A | 10/2005 |
| JP | 2005-284455 | A | 10/2005 |
| JP | 2005-293537 | A | 10/2005 |
| JP | 2005-295135 | A | 10/2005 |
| JP | 2005-306696 | A | 11/2005 |
| JP | 2005-311205 | A | 11/2005 |
| JP | 2005-321305 | A | 11/2005 |
| JP | 2005-322119 | A | 11/2005 |
| JP | 2005-327622 | A | 11/2005 |
| JP | 2005-328259 | A | 11/2005 |
| JP | 2005-333244 | A | 12/2005 |
| JP | 2005-335755 | A | 12/2005 |
| JP | 2005-340759 | A | 12/2005 |
| JP | 2005-345802 | A | 12/2005 |
| JP | 2005-346820 | A | 12/2005 |
| JP | 2005-352858 | A | 12/2005 |
| JP | 2006-013976 | A | 1/2006 |
| JP | 2006-13976 | A | 1/2006 |
| JP | 2006-025390 | A | 1/2006 |
| JP | 2006-031766 | A | 2/2006 |
| JP | 2006-033312 | A | 2/2006 |
| JP | 2006-39902 | A | 2/2006 |
| JP | 2006-039947 | A | 2/2006 |
| JP | 2006-42059 | A | 2/2006 |
| JP | 2006-42097 | A | 2/2006 |
| JP | 2006-050200 | A | 2/2006 |
| JP | 2006-053833 | A | 2/2006 |
| JP | 2006-67479 | A | 3/2006 |
| JP | 2006-72706 | A | 3/2006 |
| JP | 2006-074348 | A | 3/2006 |
| JP | 2006-80367 | A | 3/2006 |
| JP | 2006-92630 | A | 4/2006 |
| JP | 2006-102953 | A | 4/2006 |
| JP | 2006-107296 | A | 4/2006 |
| JP | 2006-513594 | A | 4/2006 |
| JP | 2006-148462 | A | 6/2006 |
| JP | 2006-148518 | A | 6/2006 |
| JP | 2006-151402 | A | 6/2006 |
| JP | 2006-174151 | A | 6/2006 |
| JP | 2006-195795 | A | 7/2006 |
| JP | 2006-203187 | A | 8/2006 |
| JP | 2006-203852 | A | 8/2006 |
| JP | 2006-217000 | A | 8/2006 |
| JP | 2006-232292 | A | 9/2006 |
| JP | 2006-237674 | A | 9/2006 |
| JP | 2006-238282 | A | 9/2006 |
| JP | 2006-246372 | A | 9/2006 |
| JP | 2006-270212 | A | 10/2006 |
| JP | 2006-270681 | A | 10/2006 |
| JP | 2006-270766 | A | 10/2006 |
| JP | 2006-285911 | A | 10/2006 |
| JP | 2006-287659 | A | 10/2006 |
| JP | 2006-295879 | A | 10/2006 |
| JP | 2006-302219 | A | 11/2006 |
| JP | 2006-309401 | A | 11/2006 |
| JP | 2006-311239 | A | 11/2006 |
| JP | 2006-323481 | A | 11/2006 |
| JP | 2006-339964 | A | 12/2006 |
| JP | 2007-007888 | A | 1/2007 |
| JP | 2007-13120 | A | 1/2007 |
| JP | 2007-013120 | A | 1/2007 |
| JP | 2007-18067 | A | 1/2007 |
| JP | 2007-019905 | A | 1/2007 |
| JP | 2007-028002 | A | 2/2007 |
| JP | 2007-28002 | A | 2/2007 |
| JP | 2007-040702 | A | 2/2007 |
| JP | 2007-043535 | A | 2/2007 |
| JP | 2007-048126 | A | 2/2007 |
| JP | 2007-65822 | A | 3/2007 |
| JP | 2007-068073 | A | 3/2007 |
| JP | 2007-79687 | A | 3/2007 |
| JP | 2007-81712 | A | 3/2007 |
| JP | 2007-096655 | A | 4/2007 |
| JP | 2007-096768 | A | 4/2007 |
| JP | 2007-102348 | A | 4/2007 |
| JP | 2007-116347 | A | 5/2007 |
| JP | 2007-122542 | A | 5/2007 |
| JP | 2007-149757 | A | 6/2007 |
| JP | 2007-150642 | A | 6/2007 |
| JP | 2007-150868 | A | 6/2007 |
| JP | 2007-159083 | A | 6/2007 |
| JP | 2007-159129 | A | 6/2007 |
| JP | 2007-166133 | A | 6/2007 |
| JP | 3975918 | B2 | 6/2007 |
| JP | 2007-172369 | A | 7/2007 |
| JP | 2007-172527 | A | 7/2007 |
| JP | 2007-194924 | A | 8/2007 |
| JP | 2007-524942 | A | 8/2007 |
| JP | 2007-228254 | A | 9/2007 |
| JP | 2007-228325 | A | 9/2007 |
| JP | 2007-228437 | A | 9/2007 |
| JP | 2007-233597 | A | 9/2007 |
| JP | 2007-241789 | A | 9/2007 |
| JP | 2007-249620 | A | 9/2007 |
| JP | 2007-266999 | A | 10/2007 |
| JP | 2007-272264 | A | 10/2007 |
| JP | 2007-279782 | A | 10/2007 |
| JP | 2007-287128 | A | 11/2007 |
| JP | 2007-295177 | A | 11/2007 |
| JP | 2007-295395 | A | 11/2007 |
| JP | 2007-295557 | A | 11/2007 |
| JP | 2007-312350 | A | 11/2007 |
| JP | 2007-324865 | A | 12/2007 |
| JP | 2008-033716 | A | 2/2008 |
| JP | 2008-042379 | A | 2/2008 |
| JP | 2008-042910 | A | 2/2008 |
| JP | 2008-72243 | A | 3/2008 |

(56) References Cited

FOREIGN PATENT DOCUMENTS

| | | | |
|---|---|---|---|
| JP | 2008-083867 | A | 4/2008 |
| JP | 2008-092131 | A | 4/2008 |
| JP | 2008-097426 | A | 4/2008 |
| JP | 2008-098993 | A | 4/2008 |
| JP | 4069958 | B2 | 4/2008 |
| JP | 2008-103691 | A | 5/2008 |
| JP | 2008-107947 | A | 5/2008 |
| JP | 2008-118359 | A | 5/2008 |
| JP | 2008-513888 | A | 5/2008 |
| JP | 2008-148345 | A | 6/2008 |
| JP | 2008-519347 | A | 6/2008 |
| JP | 2008-160821 | A | 7/2008 |
| JP | 2008-160874 | A | 7/2008 |
| JP | 2008-167190 | A | 7/2008 |
| JP | 2008-182438 | A | 8/2008 |
| JP | 2008-197714 | A | 8/2008 |
| JP | 2008-535372 | A | 8/2008 |
| JP | 2008-207875 | A | 9/2008 |
| JP | 2008-211572 | A | 9/2008 |
| JP | 2008-217406 | A | 9/2008 |
| JP | 2008-226099 | A | 9/2008 |
| JP | 2008-244739 | A | 10/2008 |
| JP | 2008-252517 | A | 10/2008 |
| JP | 2008-288915 | A | 11/2008 |
| JP | 2008-294491 | A | 12/2008 |
| JP | 2009-017284 | A | 1/2009 |
| JP | 2009-021970 | A | 1/2009 |
| JP | 2009-25870 | A | 2/2009 |
| JP | 2009-27291 | A | 2/2009 |
| JP | 2009-027291 | A | 2/2009 |
| JP | 2009-037413 | A | 2/2009 |
| JP | 2009-044647 | A | 2/2009 |
| JP | 2009-044715 | A | 2/2009 |
| JP | 3148168 | U | 2/2009 |
| JP | 2009-065426 | A | 3/2009 |
| JP | 2009-110144 | A | 5/2009 |
| JP | 2009-111950 | A | 5/2009 |
| JP | 2009-111986 | A | 5/2009 |
| JP | 2009-130896 | A | 6/2009 |
| JP | 2009-135166 | A | 6/2009 |
| JP | 2009-524363 | A | 6/2009 |
| JP | 2009-153166 | A | 7/2009 |
| JP | 4301346 | B2 | 7/2009 |
| JP | 2009-181246 | A | 8/2009 |
| JP | 2009-182630 | A | 8/2009 |
| JP | 2009-213169 | A | 9/2009 |
| JP | 2009-213171 | A | 9/2009 |
| JP | 2009-260758 | A | 11/2009 |
| JP | 2009-278441 | A | 11/2009 |
| JP | 2009-284182 | A | 12/2009 |
| JP | 2010-009196 | A | 1/2010 |
| JP | 2010-015342 | A | 1/2010 |
| JP | 2010-504598 | A | 2/2010 |
| JP | 2010-050844 | A | 3/2010 |
| JP | 2010-051012 | A | 3/2010 |
| JP | 2010-051017 | A | 3/2010 |
| JP | 2010-074839 | A | 4/2010 |
| JP | 2010-081571 | | 4/2010 |
| JP | 2010-102445 | A | 5/2010 |
| JP | 2010-171857 | A | 8/2010 |
| JP | 2010-211797 | A | 9/2010 |
| JP | 4535209 | B2 | 9/2010 |
| JP | 4561932 | B2 | 10/2010 |
| JP | 2010-268306 | A | 11/2010 |
| JP | 2010-279029 | A | 12/2010 |
| JP | 2011-015395 | A | 1/2011 |
| JP | 4609604 | B2 | 1/2011 |
| JP | 2011-076567 | A | 4/2011 |
| JP | 2011-139533 | A | 7/2011 |
| JP | 2011-142648 | A | 7/2011 |
| JP | 2011-205384 | A | 10/2011 |
| JP | 2012-033021 | A | 2/2012 |
| NL | 9100176 | A | 3/1992 |
| NL | 9100347 | A | 3/1992 |
| WO | 98/33142 | A1 | 7/1998 |
| WO | 99/67754 | A1 | 12/1999 |
| WO | 00/10122 | A2 | 2/2000 |
| WO | 01/95242 | A2 | 12/2001 |
| WO | 02/48980 | A1 | 6/2002 |
| WO | 02/061675 | A1 | 8/2002 |
| WO | 02/097723 | A1 | 12/2002 |
| WO | 03/079305 | A1 | 9/2003 |
| WO | 2004/036772 | A2 | 4/2004 |
| WO | 2004/070879 | A | 8/2004 |
| WO | 2004/072892 | A2 | 8/2004 |
| WO | 2005/073937 | A | 8/2005 |
| WO | 2005/091434 | A1 | 9/2005 |
| WO | 2005/115849 | A1 | 12/2005 |
| WO | 2006/045682 | A | 5/2006 |
| WO | 2006/048663 | A1 | 5/2006 |
| WO | 2006/049068 | A1 | 5/2006 |
| WO | 2006/114821 | A1 | 11/2006 |
| WO | 2007/013168 | A1 | 2/2007 |
| WO | 2007/060792 | A1 | 5/2007 |
| WO | 2007/083574 | A1 | 7/2007 |
| WO | 2007/083575 | A1 | 7/2007 |
| WO | 2007/086130 | A1 | 8/2007 |
| WO | 2007/094494 | A1 | 8/2007 |
| WO | 2007/097385 | A1 | 8/2007 |
| WO | 2007/099602 | A1 | 9/2007 |
| WO | 2007/100092 | A1 | 9/2007 |
| WO | 2007/102360 | A1 | 9/2007 |
| WO | 2007/105348 | A1 | 9/2007 |
| WO | 2007/119310 | A1 | 10/2007 |
| WO | 2007/125683 | A1 | 11/2007 |
| WO | 2007/132094 | A1 | 11/2007 |
| WO | 2007/138857 | A1 | 12/2007 |
| WO | 2008/001561 | A1 | 1/2008 |
| WO | 2008/007606 | A | 1/2008 |
| WO | 2008/081699 | A1 | 7/2008 |
| WO | 2008/126458 | A1 | 10/2008 |
| WO | 2008/133018 | A1 | 11/2008 |
| WO | 2008/140037 | A1 | 11/2008 |
| WO | 2008/142957 | A1 | 11/2008 |
| WO | 2009/005080 | A1 | 1/2009 |
| WO | 2009/008296 | A1 | 1/2009 |
| WO | 2009/011144 | A1 | 1/2009 |
| WO | 2009/011154 | A1 | 1/2009 |
| WO | 2009/011376 | A1 | 1/2009 |
| WO | 2009/011400 | A1 | 1/2009 |
| WO | 2009/011423 | A1 | 1/2009 |
| WO | 2009/048767 | A1 | 4/2009 |
| WO | 2009/081719 | A1 | 7/2009 |
| WO | 2009/110381 | A1 | 9/2009 |
| WO | 2009/119548 | A1 | 10/2009 |
| WO | 2009/128437 | A1 | 10/2009 |
| WO | 2009/140220 | A1 | 11/2009 |
| WO | 2009/142114 | A1 | 11/2009 |
| WO | 2010/026939 | A1 | 3/2010 |
| WO | 2010/050361 | A1 | 5/2010 |
| WO | 2010/079830 | A1 | 7/2010 |
| WO | 2010/104179 | A1 | 9/2010 |
| WO | 2010/119854 | A1 | 10/2010 |
| WO | 2011/062274 | A1 | 5/2011 |

OTHER PUBLICATIONS

Official Communication issued in International Patent Application No. PCT/JP2009/056934, mailed on Jun. 30, 2009.

Kato et al.: "Wireless IC Device"; U.S. Appl. No. 12/903,242, filed Oct. 13, 2010.

Kato et al.: "Wireless IC Device"; U.S. Appl. No. 12/940,103, filed Nov. 5, 2010.

Kato et al.: "Wireless IC Device System and Method of Determining Authenticity of Wireless IC Device"; U.S. Appl. No. 12/940,105, filed Nov. 5, 2010.

Official Communication issued in International Patent Application No. PCT/JP2009/059669, mailed on Aug. 25, 2009.

Official Communication issued in International Patent Application No. PCT/JP2009/062181, mailed on Oct. 13, 2009.

Official Communication issued in corresponding Japanese Application No. 2010-501323, mailed on Apr. 6, 2010.

Kato et al.: "Component of Wireless IC Device and Wireless IC Device"; U.S. Appl. No. 12/944,099, filed Nov. 11, 2010.

(56) References Cited

OTHER PUBLICATIONS

Kato et al.: Wireless IC Device and Manufacturing Method Thereof; U.S. Appl. No. 12/961,599, filed Dec. 7, 2010.
Kataya et al.: "Radio Frequency IC Device and Electronic Apparatus"; U.S. Appl. No. 12/959,454, filed Dec. 3, 2010.
Ikemoto et al.:"Radio IC Device"; U.S. Appl. No. 12/981,582, filed Dec. 30, 2010.
Official Communication issued in International Patent Application No. PCT/JP2009/062801, mailed on Oct. 27, 2009.
Ikemoto et al.: "Wireless IC Device and Electronic Apparatus"; U.S. Appl. No. 13/022,695, filed Feb. 8, 2011.
Official Communication issued in International Patent Application No. PCT/JP2009/067778, mailed on Jan. 26, 2010.
Kato: "Wireless IC Device and Method for Manufacturing Same"; U.S. Appl. No. 13/022,693, filed Feb. 8, 2011.
Kato: "Wireless IC Device"; U.S. Appl. No. 13/080,781, filed Apr. 6, 2011.
Official Communication issued in International Patent Application No. PCT/JP2009/069486, mailed on Mar. 2, 2010.
Kato: "Radio IC Device"; U.S. Appl. No. 13/080,775, filed Apr. 6, 2011.
Kato et al.: "Antenna and Wireless IC Device"; U.S. Appl. No. 13/083,626, filed Apr. 11, 2011.
Official Communication issued in International Patent Application No. PCT/JP2009/070617, mailed on Mar. 16, 2010.
Nagai, "Mounting Technique of RFID by Roll-To-Roll Process", Material Stage, Technical Information Institute Co., Ltd, vol. 7, No. 9, 2007, pp. 4-12.
Dokai et al.: "Wireless IC Device"; U.S. Appl. No. 13/088,480, filed Apr. 18, 2011.
Kato et al.: "High-Frequency Device and Wireless IC Device"; U.S. Appl. No. 13/094,928, filed Apr. 27, 2011.
Dokai et al.: "Wireless IC Device"; U.S. Appl. No. 13/099,392, filed May 3, 2011.
Kato et al.: "Radio Frequency IC Device"; U.S. Appl. No. 13/163,803, filed Jun. 20, 2011.
Official Communication issued in International Patent Application No. PCT/JP2010/050170, mailed on Apr. 13, 2010.
Official Communication issued in International Patent Application No. PCT/JP2010/051205, mailed on May 11, 2010.
Kato: "Wireless IC Device, Wireless IC Module and Method of Manufacturing Wireless IC Module"; U.S. Appl. No. 13/169,067, filed Jun. 27, 2011.
Kato et al.: "Antenna and Wireless IC Device"; U.S. Appl. No. 13/190,670, filed Jul. 26, 2011.
Shiroki et al.: "RFIC Chip Mounting Structure"; U.S. Appl. No. 13/223,429, filed Sep. 1, 2011.
Official Communication issued in International Patent Application No. PCT/JP2010/056559, mailed on Jul. 27, 2010.
Taniguchi et al.: "Antenna Device and Radio Frequency IC Device"; U.S. Appl. No. 13/232,102, filed Sep. 14, 2011.
Official Communication issued in International Patent Application No. PCT/JP2009/066336, mailed on Dec. 22, 2009.
Official Communication issued in corresponding Japanese Patent Application No. 2010-509439, mailed on Jul. 6, 2010.
Official Communication issued in corresponding Japanese Patent Application No. 2011-032311, mailed on Mar. 29, 2011.
Official Communication issued in corresponding Japanese Patent Application No. 2009-525327, drafted on Sep. 22, 2010.
Official Communication issued in corresponding Japanese Patent Application No. 2011-032311, mailed on Aug. 2, 2011.
Official Communication issued in corresponding Japanese Patent Application No. 2011-032312, mailed on Aug. 2, 2011.
Official Communication issued in corresponding Japanese Patent Application No. 2011-032311, mailed on Aug. 23, 2011.
Kato et al.: "Wireless IC Device Component and Wireless IC Device"; U.S. Appl. No. 13/241,823, filed Sep. 23, 2011.
Kato et al.: "Antenna Device and Method of Setting Resonant Frequency of Antenna Device"; U.S. Appl. No. 13/272,365, filed Oct. 13, 2011.
Official Communication issued in International Patent Application No. PCT/JP2010/056812, mailed on Jul. 13, 2010.
Dokai et al.: "Optical Disc"; U.S. Appl. No. 13/295,153, filed Nov. 14, 2011.
Official Communication issued in International Patent Application No. PCT/JP2010/057668, mailed on Aug. 17, 2010.
Osamura et al.: "Radio Frequency IC Device and Method of Manufacturing the Same"; U.S. Appl. No. 13/308,575, filed Dec. 1, 2011.
Official Communication issued in International Patent Application No. PCT/JP2010/069417, mailed on Dec. 7, 2010.
Kato: "Wireless IC Device and Coupling Method for Power Feeding Circuit and Radiation Plate"; U.S. Appl. No. 13/325,273, filed Dec. 14, 2011.
Official Communication issued in International Patent Application No. PCT/JP2012/072849, mailed on Nov. 20, 2012.
Kimura et al.: "Wireless Communication Device"; U.S. Appl. No. 14/082,435, filed Nov. 18, 2013.
Kato: "Antenna Device and Wireless Device"; U.S. Appl. No. 14/085,830, filed Nov. 21, 2013.
Kato et al.: "Wireless IC Device Component and Wireless IC Device"; U.S. Appl. No. 14/151,852, filed Jan. 10, 2014.
Kato: "Wireless IC Device and Electromagnetic Coupling Module"; U.S. Appl. No. 14/160,597, filed Jan. 22, 2014.
Kato et al.: "Wireless IC Device"; U.S. Appl. No. 14/162,806, filed Jan. 24, 2014.
Kato et al.: "Antenna Device and Wireless Communication Device"; U.S. Appl. No. 14/171,004, filed Feb. 3, 2014.
Kato et al.: "Antenna and Wireless IC Device"; U.S. Appl. No. 14/182,339, filed Feb. 18, 2014.
Kimura et al., "Wireless Communication Device", U.S. Appl. No. 14/187,364, filed Feb. 24, 2014.
English translation of NL9100176, published on Mar. 2, 1992.
English translation of NL9100347, published on Mar. 2, 1992.
Kato et al.: "Antenna"; U.S. Appl. No. 11/928,502, filed Oct. 30, 2007.
Kato et al.: "Wireless IC Device"; U.S. Appl. No. 12/211,117, filed Sep. 16, 2008.
Kato et al.: "Antenna"; U.S. Appl. No. 11/688,290, filed Mar. 20, 2007.
Kato et al.: "Electromagnetic-Coupling-Module-Attached Article"; U.S. Appl. No. 11/740,509, filed Apr. 26, 2007.
Kato et al.: "Product Including Power Supply Circuit Board"; U.S. Appl. No. 12/234,949, filed Sep. 22, 2008.
Kato et al.: "Data Coupler"; U.S. Appl. No. 12/252,475, filed Oct. 16, 2008.
Kato et al.; "Information Terminal Device"; U.S. Appl. No. 12/267,666, filed Nov. 10, 2008.
Kato et al.: "Wireless IC Device and Wireless IC Device Composite Component"; U.S. Appl. No. 12/276,444, filed Nov. 24, 2008.
Dokai et al.: "Optical Disc"; U.S. Appl. No. 12/326,916, filed Dec. 3, 2008.
Dokai et al.: "System for Inspecting Electromagnetic Coupling Modules and Radio IC Devices and Method for Manufacturing Electromagnetic Coupling Modules and Radio IC Devices Using the System"; U.S. Appl. No. 12/274,400, filed Nov. 20, 2008.
Kato: "Wireless IC Device"; U.S. Appl. No. 11/964,185, filed Dec. 26, 2007.
Kato et al.: "Radio Frequency IC Device"; U.S. Appl. No. 12/336,629, filed Dec. 17, 2008.
Kato et al.: "Wireless IC Device and Component for Wireless IC Device"; U.S. Appl. No. 12/339,198, filed Dec. 19, 2008.
Ikemoto et al.: "Wireless IC Device"; U.S. Appl. No. 11/851,651, filed Sep. 7, 2007.
Kataya et al.: "Wireless IC Device and Electronic Device"; U.S. Appl. No. 11/851,661, filed Sep. 7, 2007.
Dokai et al.: "Antenna and Radio IC Device"; U.S. Appl. No. 12/350,307, filed Jan. 8, 2009.
Official Communication issued in International Patent Application No. PCT/JP2010/053496, mailed on Jun. 1, 2010.
Ikemoto: "Wireless IC Tag, Reader-Writer, and Information Processing System"; U.S. Appl. No. 13/329,354, filed Dec. 19, 2011.
Kato et al.: "Antenna and Antenna Module"; U.S. Appl. No. 13/334,462, filed Dec. 22, 2011.

(56) References Cited

OTHER PUBLICATIONS

Official Communication issued in International Patent Application No. PCT/JP2010/069418, mailed on Feb. 8, 2011.
Official Communication issued in International Patent Application No. PCT/JP2010/063082, mailed on Nov. 16, 2010.
Ikemoto: "Communication Terminal and Information Processing System"; U.S. Appl. No. 13/412,772, filed Mar. 6, 2012.
"Antenna Engineering Handbook", The Institute of Electronics and Communication Engineers, Mar. 5, 1999, pp. 20-21.
Official Communication issued in International Patent Application No. PCT/JP2010/066714, mailed on Dec. 14, 2010.
Nomura et al.: "Antenna and Wireless IC Device"; U.S. Appl. No. 13/419,454, filed Mar. 14, 2012.
Official Communication issued in International Patent Application No. PCT/JP2010/070607, mailed on Feb. 15, 2011.
Ito: "Wireless IC Device and Method of Detecting Environmental State Using the Device"; U.S. Appl. No. 13/421,889, filed Mar. 16, 2012.
Official Communication issued in International Patent Application No. PCT/JP2011/053654, mailed on Mar. 29, 2011.
Kato et al.: "Antenna Device and Mobile Communication Terminal"; U.S. Appl. No. 13/425,505, filed Mar. 21, 2012.
Official Communication issued in International Patent Application No. PCT/JP2010/069416, mailed on Feb. 8, 2011.
Kato et al.: "Wireless Communication Device and Metal Article"; U.S. Appl. No. 13/429,465, filed Mar. 26, 2012.
Official Communication issued in International Patent Application No. PCT/JP2011/055344, mailed on Jun. 14, 2011.
Kubo et al.: "Antenna and Mobile Terminal"; U.S. Appl. No. 13/452,972, filed Apr. 23, 2012.
Ikemoto: "RFID System"; U.S. Appl. No. 13/457,525, filed Apr. 27, 2012.
Ikemoto et al.: "Wireless IC Device and Electronic Apparatus"; U.S. Appl. No. 13/468,058, filed May 10, 2012.
Official Communication issued in International Patent Application No. PCT/JP2010/066291, mailed on Dec. 28, 2010.
Ikemoto: "Communication Terminal and Information Processing System"; U.S. Appl. No. 13/432,002, filed Mar. 28, 2012.
Official Communication issued in International Patent Application No. PCT/JP2010/070767, mailed on Feb. 22, 2011.
Ieki et al.: "Transceiver and Radio Frequency Identification Tag Reader"; U.S. Appl. No. 13/437,978, filed Apr. 3, 2012.
Official Communication issued in International Patent Application No. PCT/JP2011/065431, mailed on Oct. 18, 2011.
Kato et al.: "Wireless IC Device"; U.S. Appl. No. 13/470,486, filed May 14, 2012.
Kato: "Wireless IC Device"; U.S. Appl. No. 12/789,610, filed May 28, 2010.
Kato: "Antenna and RFID Device"; U.S. Appl. No. 13/472,520, filed May 16, 2012.
Kato et al.: "Wireless IC Device and Component for Wireless IC Device"; U.S. Appl. No. 13/540,694, filed Jul. 3, 2012.
Dokai et al.: "Wireless IC Device and Component for Wireless IC Device"; U.S. Appl. No. 13/567,108, filed Aug. 6, 2012.
Dokai et al.: "Wireless IC Device and Component for Wireless IC Device"; U.S. Appl. No. 13/567,109, filed Aug. 6, 2012.
Official Communication issued in International Patent Application No. PCT/JP2011/052594, mailed on May 17, 2011.
Kato et al.: "Wireless IC Device"; U.S. Appl. No. 13/585,866, filed Aug. 15, 2012.
Kato et al.: "Radio Communication Device and Radio Communication Terminal"; U.S. Appl. No. 13/600,256, filed Aug. 31, 2012.
Murayama et al.: "Wireless Communication Module and Wireless Communication Device"; U.S. Appl. No. 13/598,872, filed Aug. 30, 2012.
Official Communication issued in International Patent Application No. PCT/JP2011/069689, mailed on Oct. 4, 2011.
Official Communication issued in corresponding Japanese Patent Application No. 2011-552116, mailed on Apr. 17, 2012.
Tsubaki et al.: "RFID Module and RFID Device"; U.S. Appl. No. 13/603,627, filed Sep. 5, 2012.
Kato et al.: "Antenna Device and Method of Setting Resonant Frequency of Antenna Device"; U.S. Appl. No. 13/604,807, filed Sep. 6, 2012.
Kato et al.: "Antenna Device and Method of Setting Resonant Frequency of Antenna Device"; U.S. Appl. No. 13/604,801, filed Sep. 6, 2012.
Official Communication issued in International Patent Application No. PCT/JP2011/053656, mailed on May 17, 2011.
Official Communication issued in International Application No. PCT/JP2007/066007, mailed on Nov. 27, 2007.
Dokai et al.: "Wireless IC Device and Component for Wireless IC Device"; U.S. Appl. No. 12/359,690, filed Jan. 26, 2009.
Dokai et al.: "Test System for Radio Frequency IC Devices and Method of Manufacturing Radio Frequency IC Devices Using the Same", U.S. Appl. No. 12/388,826, filed Feb. 19, 2009.
Official Communication issued in International Application No. PCT/JP2008/061955, mailed on Sep. 30, 2008.
Official Communication issued in International Application No. PCT/JP2007/066721, mailed on Nov. 27, 2007.
Official Communication issued in International Application No. PCT/JP2007/070460, mailed on Dec. 11, 2007.
Kato et al.: "Wireless IC Device"; U.S. Appl. No. 12/390,556, filed Feb. 23, 2009.
Kato et al.: "Inductively Coupled Module and Item With Inductively Coupled Module"; U.S. Appl. No. 12/398,497, filed Mar. 5, 2009.
Official Communication issued in International Patent Application No. PCT/JP2008/050945, mailed on May 1, 2008.
Kato et al.: "Article Having Electromagnetic Coupling Module Attached Thereto"; U.S. Appl. No. 12/401,767, filed Mar. 11, 2009.
Taniguchi et al.: "Antenna Device and Radio Frequency IC Device"; U.S. Appl. No. 12/326,117, filed Dec. 2, 2008.
Official Communication issued in International Patent Application No. PCT/JP2008/061442, mailed on Jul. 22, 2008.
Kato et al.: "Container With Electromagnetic Coupling Module"; U.S. Appl. No. 12/426,369, filed Apr. 20, 2009.
Kato: "Wireless IC Device"; U.S. Appl. No. 12/429,346, filed Apr. 24, 2009.
Official communication issued in Japanese Application No. 2007-531524, mailed on Sep. 11, 2007.
Official communication issued in Japanese Application No. 2007-531525, mailed on Sep. 25, 2007.
Official communication issued in Japanese Application No. 2007-531524, mailed on Dec. 12, 2007.
Official communication issued in European Application No. 07706650.4, mailed on Nov. 24, 2008.
Mukku-Sha, "Musen IC Tagu Katsuyo-no Subete" "(All About Wireless IC Tags"), RFID, pp. 112-126.
Dokai et al.: "Wireless IC Device and Component for Wireless IC Device"; U.S. Appl. No. 11/624,382, filed Jan. 18, 2007.
Dokai et al.: "Wireless IC Device, and Component for Wireless IC Device"; U.S. Appl. No. 11/930,818, filed Oct. 31, 2007.
Kato et al.: "Wireless IC Device"; U.S. Appl. No. 12/042,399, filed Mar. 5, 2008.
Official communication issued in related U.S. Appl. No. 12/042,399; mailed on Aug. 25, 2008.
Official communication issued in counterpart International Application No. PCT/JP2008/071502, mailed Feb. 24, 2009.
Kato et al.: "Wireless IC Device and Manufacturing Method Thereof," U.S. Appl. No. 12/432,854, filed Apr. 30, 2009.
Official communication issued in counterpart International Application No. PCT/JP2008/058168, mailed Aug. 12, 2008.
Official communication issued in counterpart International Application No. PCT/JP2008/062886, mailed Oct. 21, 2008.
Kato et al.: "Wireless IC Device," U.S. Appl. No. 12/469,896, filed May 21, 2009.
Ikemoto et al.: "Wireless IC Device," U.S. Appl. No. 12/496,709, filed Jul. 2, 2009.
Official communication issued in counterpart International Application No. PCT/JP2008/062947, mailed Aug. 19, 2008.
Official communication issued in counterpart International Application No. PCT/JP2008/056026, mailed Jul. 1, 2008.

(56) References Cited

OTHER PUBLICATIONS

Ikemoto et al.: "Wireless IC Device and Electronic Apparatus," U.S. Appl. No. 12/503,188, filed Jul. 15, 2009.
Official communication issued in counterpart International Application No. PCT/JP2008/055567, mailed May 20, 2008.
Official communication issued in counterpart International Application No. PCT/JP2008/051853, mailed Apr. 22, 2008.
Official communication issued in counterpart International Application No. PCT/JP2008/057239, mailed Jul. 22, 2008.
Kimura et al.: "Wireless IC Device," U.S. Appl. No. 12/510,338, filed Jul. 28, 2009.
Kato et al.: "Wireless IC Device," U.S. Appl. No. 12/510,340, filed Jul. 28, 2009.
Kato: "Wireless IC Device," U.S. Appl. No. 12/510,344, filed Jul. 28, 2009.
Kato et al.: "Wireless IC Device," U.S. Appl. No. 12/510,347, filed Jul. 28, 2009.
Official communication issued in counterpart European Application No. 08 77 7758, dated on Jun. 30, 2009.
Official communication issued in counterpart Japanese Application No. 2008-103741, mailed on May 26, 2009.
Official communication issued in counterpart Japanese Application No. 2008-103742, mailed on May 26, 2009.
Official communication issued in International Application No. PCT/JP2008/050358, mailed on Mar. 25, 2008.
Official communication issued in International Application No. PCT/JP2008/050356, mailed on Mar. 25, 2008.
Osamura et al.: "Packaging Material with Electromagnetic Coupling Module," U.S. Appl. No. 12/536,663, filed Aug. 6, 2009.
Osamura et al.: "Packaging Material with Electromagnetic Coupling Module," U.S. Appl. No. 12/536,669, filed Aug. 6, 2009.
Dokai et al.: "Wireless IC Device and Component for Wireless IC Device," U.S. Appl. No. 12/543,553, filed Aug. 19, 2009.
Shioya et al.: "Wireless IC Device," U.S. Appl. No. 12/551,037, filed Aug. 31, 2009.
Ikemoto: "Wireless IC Device and Manufacturing Method Thereof," U.S. Appl. No. 12/579,672, filed Oct. 15, 2009.
Official communication issued in International Application No. PCT/JP2008/058614, mailed on Jun. 10, 2008.
Official Communication issued in International Patent Application No. PCT/JP2011/068110, mailed on Sep. 20, 2011.
Dokai et al.: "Antenna and Wireless Communication Device"; U.S. Appl. No. 13/613,021, filed Sep. 13, 2012.
Takeoka et al: "Printed Wiring Board and Wireless Communication System"; U.S. Appl. No. 13/616,140, filed Sep. 14, 2012.
Dokai: "Wireless IC Device, Wireless IC Module and Method of Manufacturing Wireless IC Module"; U.S. Appl. No. 13/688,287, filed Nov. 29, 2012.
Official Communication issued in International Patent Application No. PCT/JP2011/067127, mailed on Oct. 18, 2011.
Kato et al.: "Wireless Communication Device and Metal Article"; U.S. Appl. No. 13/691,996, filed Dec. 3, 2012.
Yosui: "Antenna Apparatus and Communication Terminal Instrument"; U.S. Appl. No. 13/706,409, filed Dec. 6, 2012.
Official Communication issued in International Patent Application No. PCT/JP2011/071795, mailed on Dec. 27, 2011.
Dokai et al.: "Wireless IC Device"; U.S. Appl. No. 13/738,143, filed Jan. 10, 2013.
Official Communication issued in International Patent Application No. PCT/JP2011/074009, mailed on Dec. 20, 2011.
Kato et al.: "Electromagnetic-Coupling-Module-Attached Article"; U.S. Appl. No. 13/754,972, filed Jan. 31, 2013.
Kimura et al.: "Electrical Product"; U.S. Appl. No. 13/757,991, filed Feb. 4, 2013.
Nakano et al.: "Communication Terminal Device"; U.S. Appl. No. 13/760,196, filed Feb. 6, 2013.
Official Communication issued in International Patent Application No. PCT/JP2011/073054, mailed on Dec. 20, 2011.
Official Communication issued in International Patent Application No. PCT/JP2011/073490, mailed on Jan. 10, 2012.
Kato et al.: "Antenna Device and Communication Terminal Apparatus"; U.S. Appl. No. 13/761,195, filed Feb. 7, 2013.
Kato et al.: "Antenna Device and Mobile Communication Terminal"; U.S. Appl. No. 13/767,960, filed Feb. 15, 2013.
Official Communication issued in International Patent Application No. PCT/JP2012/058884, mailed on Jun. 12, 2012.
Dokai et al.: "Wireless Communication Device"; U.S. Appl. No. 13/782,346, filed Mar. 1, 2013.
Official Communication issued in International Patent Application No. PCT/JP2012/053344, mailed on May 22, 2012.
Official Communication issued in International Patent Application No. PCT/JP2008/063025, mailed on Aug. 12, 2008.
Kato et al.: "Wireless IC Device," U.S. Appl. No. 12/603,608, filed Oct. 22, 2009.
Kato et al.: "Wireless IC Device," U.S. Appl. No. 12/688,072, filed Jan. 15, 2010.
Official Communication issued in International Patent Application No. PCT/JP2009/053693, mailed on Jun. 9, 2009.
Kato: "Composite Antenna," U.S. Appl. No. 12/845,846, filed Jul. 29, 2010.
Official Communication issued in International Patent Application No. PCT/JP2009/055758, mailed on Jun. 23, 2009.
Kato et al.: "Radio Frequency IC Device and Radio Communication System," U.S. Appl. No. 12/859,340, filed Aug. 19, 2010.
Official Communication issued in International Patent Application No. PCT/JP2009/055758, mailed Jun. 23, 2009.
Kato et al.: "Wireless IC Device," U.S. Appl. No. 12/859,880, filed Aug. 20, 2010.
Official Communication issued in International Patent Application No. PCT/JP2009/057482, mailed on Jul. 21, 2009.
Kataya et al.: "Wireless IC Device, Electronic Apparatus, and Method for Adjusting Resonant Frequency of Wireless IC Device," U.S. Appl. No. 12/861,945, filed Aug. 24, 2010.
Kato: "Wireless IC Device and Electromagnetic Coupling Module," U.S. Appl. No. 12/890,895, filed Sep. 27, 2010.
Official Communication issued in International Patent Application No. PCT/JP2009/059410, mailed on Aug. 4, 2009.
Kato et al.: "Wireless IC Device" U.S. Appl. No. 12/902,174, filed Oct. 12, 2010.
Official Communication issued in International Patent Application No. PCT/JP2009/059259, mailed on Aug. 11, 2009.
Official Communication issued in corresponding Japanese Patent Application No. 2010-506742, mailed on Apr. 6, 2010.
Official Communication issued in International Patent Application No. PCT/JP2009/056698, mailed on Jul. 7, 2009.
Official Communication issued in International Patent Application No. PCT/JP2012/050557, mailed on Apr. 10, 2012.
Kimura et al.: "Wireless Communication Device"; U.S. Appl. No. 13/789,761, filed Mar. 8, 2013.
Dokai et al.: "RFID Chip Package and RFID Tag"; U.S. Appl. No. 13/792,650, filed Mar. 11, 2013.
Kato et al.: "Wireless IC Device Component and Wireless IC Device"; U.S. Appl. No. 13/794,929, filed Mar. 12, 2013.
Kato et al.: "Wireless IC Device and Component for Wireless IC Device"; U.S. Appl. No. 13/848,748, filed Mar. 22, 2013.
Official Communication issued in International Patent Application No. PCT/JP2012/080493, mailed on Dec. 25, 2012.
Mukai et al.: "Inspection Method and Inspection Device for RFID Tag"; U.S. Appl. No. 13/933,184, filed Jul. 2, 2013.
Kato et al.: "Antenna Device and Method of Setting Resonant Frequency of Antenna Device"; U.S. Appl. No. 13/941,760, filed Jul. 15, 2013.
Kato et al.: "Antenna Device and Method of Setting Resonant Frequency of Antenna Device"; U.S. Appl. No. 13/943,973, filed Jul. 17, 2013.
Official Communication issued in International Patent Application No. PCT/JP2012/080700, mailed on Jan. 15, 2013.
Mukai et al.: "Wireless Integrated Circuit Device and Method of Manufacturing the Same"; U.S. Appl. No. 13/961,995, filed Aug. 8, 2013.
Kato et al.: "Radio IC Device"; U.S. Appl. No. 13/964,234, filed Aug. 12, 2013.

(56) References Cited

OTHER PUBLICATIONS

Official Communication issued in International Patent Application No. PCT/JP2012/067779, mailed on Aug. 28, 2012.
Official Communication issued in International Patent Application No. PCT/JP2013/051254, mailed on Apr. 2, 2013.
Dokai: "Wireless Communication Device"; U.S. Appl. No. 13/970,633, filed Aug. 20, 2013.
Official Communication issued in International Patent Application No. PCT/JP2012/059350, mailed on Jul. 3, 2012.
Dokai: "Wireless IC Device"; U.S. Appl. No. 14/011,823, filed Aug. 28, 2013.
Official Communication issued in International Patent Application No. PCT/JP2012/055505, mailed on Jun. 5, 2012.
Kato: "Radio IC Device and Radio Communication Terminal"; U.S. Appl. No. 14/017,406, filed Sep. 4, 2013.
Official Communication issued in International Patent Application No. PCT/JP2012/067454, mailed on Aug. 7, 2012.
Kato: "Antenna Device and Communication Terminal Apparatus"; U.S. Appl. No. 14/019,573, filed Sep. 6, 2013.
Official Communication issued in International Patent Application No. PCT/JP2012/067537, mailed on Oct. 9, 2012.
Kato: "Radio Communication Device"; U.S. Appl. No. 14/027,384, filed Sep. 16, 2013.
Kato: "Antenna Device, RFID Tag, and Communication Terminal Apparatus"; U.S. Appl. No. 14/031,270, filed Sep. 19, 2013.
Kato et al.: "Wireless IC Device"; U.S. Appl. No. 14/054,865, filed Oct. 16, 2013.
Official Communication issued in International Patent Application No. PCT/JP2012/062259, mailed on Jun. 12, 2012.
Dokai et al.: "Radio IC Device"; U.S. Appl. No. 14/078,596, filed Nov. 13, 2013.
Official Communication issued in corresponding Japanese Patent Application No. 2012-508139, mailed on Apr. 22, 2014.

* cited by examiner

ANTENNA AND WIRELESS COMMUNICATION DEVICE

BACKGROUND OF THE INVENTION

1. Field of the Invention

The present invention relates to antennas and wireless communication devices, and more specifically to antennas and wireless communication devices preferably for use in radio frequency identification (RFID) systems.

2. Description of the Related Art

In recent years, RFID systems have been commercialized as article information management systems. In RFID systems, non-contact communication through an electromagnetic field is performed between a reader/writer that generates an induction field and an RFID tag (also called a wireless communication device) attached to an article, whereby predetermined information is transmitted. This RFID tag includes a wireless IC chip that stores predetermined information and processes a predetermined wireless signal and an antenna (radiation body) that transmits and receives a high-frequency signal.

Japanese Unexamined Patent Application Publication No. 2007-96655 discloses an antenna for an RFID tag. In this antenna, which is a bent dipole antenna, impedance is adjusted by forming a slit near a feeding portion. Further, Japanese Unexamined Patent Application Publication No. 2008-160821 discloses an antenna that includes a first loop conductor pattern and second and third conductor patterns connected to the first conductor pattern. In this antenna, which receives circularly polarized waves through the first conductor pattern, impedance is adjusted through adjustment of the lengths of the second and third conductor patterns.

However, the antenna disclosed in Japanese Unexamined Patent Application Publication No. 2007-96655, in which a portion of the dipole antenna is used for impedance adjustment, has a problem in that radiation characteristics such as directivity and gain may be changed depending on a change in the shape of the slit caused by the adjustment. Further, the antenna disclosed in Japanese Unexamined Patent Application Publication No. 2008-160821, in which the first conductor pattern is directly electrically connected to the second and third conductor patterns and, hence, a portion of the first conductor pattern contributes to the impedance adjustment, has a problem in that radiation characteristics such as directivity and gain may be changed as a result of the adjustment, similarly to the antenna disclosed in Japanese Unexamined Patent Application Publication No. 2007-96655.

SUMMARY OF THE INVENTION

Accordingly, preferred embodiments of the present invention provide an antenna and a wireless communication device, appropriate for RFID systems, in which radiation characteristics are prevented from being changed as a result of impedance adjustment.

An antenna according to a first preferred embodiment of the present invention includes a first loop electrode that has an external shape of a regular polygon or circle and that includes a pair of open ends, feeding portions arranged inside the first loop electrode, a second loop electrode connected to the feeding portions, and a coupling electrode that couples the first loop electrode and the second loop electrode to each other.

A wireless communication device according to a second preferred embodiment of the present invention includes a first loop electrode that has an external shape of a regular polygon or circle and that includes a pair of open ends, feeding portions arranged inside the first loop electrode, a second loop electrode connected to the feeding portions, a coupling electrode that couples the first loop electrode and the second loop electrode to each other, and a wireless communication element coupled to the feeding portions.

In the antenna, the first loop electrode functions as a radiation portion and the second loop electrode functions as an impedance matching portion. Since the first loop electrode and the second loop electrode are coupled to each other through the coupling electrode, independence of the first loop antenna and the second loop antenna is ensured. In other words, even when the second loop electrode is adjusted for impedance matching, the radiation characteristics of the first loop electrode, such as directivity and gain, are maintained.

The above and other elements, features, steps, characteristics and advantages of the present invention will become more apparent from the following detailed description of the preferred embodiments with reference to the attached drawings.

BRIEF DESCRIPTION OF THE DRAWINGS

FIGS. 1A and 1B illustrate an antenna according to a first preferred embodiment of the present invention wherein FIG. 1A is a plan view and FIG. 1B is a diagram explaining functions.

DETAILED DESCRIPTION OF THE PREFERRED EMBODIMENTS

Hereinafter, preferred embodiments of an antenna and a wireless communication device according to the present invention will be described with reference to the drawings. Note that identical elements and portions in the figures are denoted by the same reference symbols and duplicate descriptions thereof are omitted.

First Preferred Embodiment

Figure 1A:
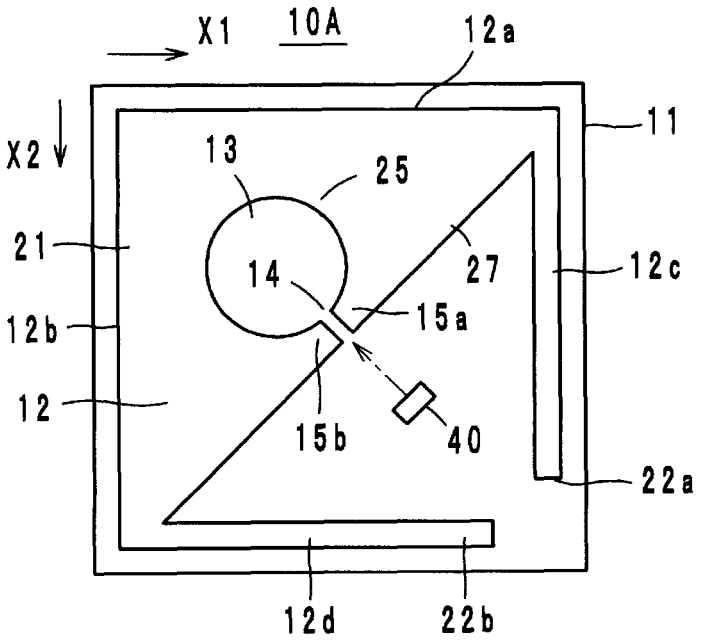

Referring to FIG. 1A, in an antenna 10A according to a first preferred embodiment, which is used for communication in the UHF band, a plate electrode 12 preferably having an external shape of a triangle, for example, is provided on the surface of a substrate 11 that is preferably square-shaped or substantially square-shaped. A resin film, such as a PET film, is preferably used as the substrate 11, for example. The plate electrode 12 preferably is a thin film conductor made of a metal foil such as a copper or aluminum foil, or is a thick film conductor made from conductive paste including silver or copper powder, for example.

In more detail, a first loop electrode 21 preferably has an external shape that is square-shaped or substantially square-shaped, and includes side portions 12*a* and 12*b* of the plate electrode 12 and line portions 12*c* and 12*d* that extend from the side portions 12*a* and 12*b*.

The tips of the line portions 12*c* and 12*d* include open ends 22*a* and 22*b*. A circular opening 13 and a slit portion 14 that communicates with the opening 13 are formed in the plate electrode 12. Opposing portions of the slit portion 14 define feeding portions 15*a* and 15*b*. The feeding portions 15*a* and 15*b* are located inside the first loop electrode 21 and are coupled to a wireless communication element 40.

The wireless communication element 40 preferably is an element in the form of a chip and processes a high-frequency signal. The wireless communication element 40 may be simply a wireless IC chip or may be formed as a feeding circuit substrate that includes a wireless IC chip and a resonant circuit having a predetermined resonant frequency. The wireless IC chip preferably includes a clock circuit, a logic circuit, a memory circuit, and the like and stores necessary information. The wireless communication element 40 may be directly electrically connected to or coupled through an electromagnetic field to the feeding portions 15*a* and 15*b*.

A second loop electrode 25 is located in a peripheral portion surrounding the opening 13 and the two ends thereof are connected to the feeding portions 15*a* and 15*b*. Coupling electrodes 27 are located at the periphery (specifically, bottom side portion) of the plate electrode 12 and couple the first loop electrode 21 and the second loop electrode 25 to each other.

Figure 1B:
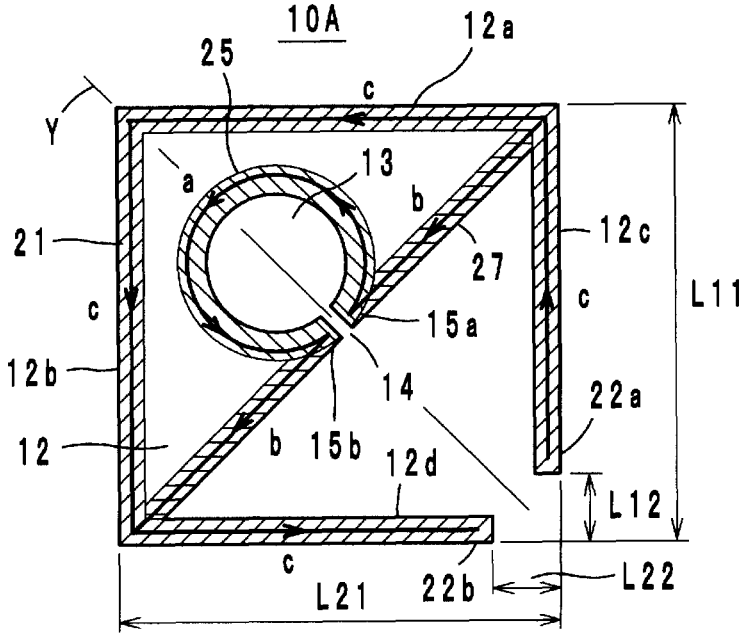

Here, referring to FIG. 1B, to illustrate the first and second loop electrodes 21 and 25 and the coupling electrodes 27 so as to be easily recognizable, the first loop electrode 21 is a portion shaded with lines rising toward the right and the second loop electrode 25 is a portion shaded with lines falling toward the right. In addition, the coupling electrodes 27 are portions shaded with horizontal lines. The first loop electrode 21 and the second loop electrode 25 preferably are symmetrical or substantially symmetrical about a virtual straight line Y that passes through the open ends 22*a* and 22*b* and the feeding portions 15*a* and 15*b*. In other words, the first and second loop electrodes 21 and 25 are preferably line-symmetrical or substantially line-symmetrical about the virtual straight line Y that passes through the opposing apexes of the nearly square loop electrode.

In the antenna 10A configured as described above, a predetermined high-frequency signal output from the wireless communication element 40 is transmitted through the feeding portions 15*a* and 15*b* over the second loop electrode 25 (refer to an arrow a), is transmitted through the coupling electrodes 27 over the first loop electrode 21 (refer to arrows b and c), and is radiated outward from the first loop electrode 21. On the other hand, a high-frequency signal received by the first loop electrode 21 is transmitted over the second loop electrode 25 through the coupling electrodes 27, and is supplied to the wireless communication element 40 through the feeding portions 15*a* and 15*b*. As a result, communication with the reader/writer of an RFID system is achieved.

In other words, in the first preferred embodiment, the first loop electrode 21 functions as a radiation portion and the second loop electrode 25 functions as an impedance matching portion between the wireless communication element 40 and the first loop electrode 21. The impedance can be adjusted by adjusting the diameter or shape of the opening 13. Since the first loop electrode 21 and the second loop electrode 25 are coupled to each other through the coupling electrodes 27, independence of the first loop electrode 21 and the second loop electrode 25 is ensured. Specifically in the first preferred embodiment, it is preferred that the first loop electrode 21 is arranged in a peripheral portion, the second loop electrode 25 is arranged inside the first loop electrode 21, and the feeding portions 15*a* and 15*b* are arranged in the central portion of the first loop electrode 21. Hence, the distance between the first loop electrode 21 and the second loop electrode 25 and the distances between the first loop electrode 21 and the feeding portions 15*a* and 15*b* are large and, hence, there is a high degree of independence between the first loop electrode 21 and the second loop electrode 25 and between the first loop electrode 21 and the feeding portions 15*a* and 15*b*.

As a result, it is unlikely that the radiation characteristics (directivity, gain, etc.) of the first loop electrode 21 are influenced by the second loop electrode 25 or the feeding portions 15*a* and 15*b*. In other words, even when the second loop electrode 25 is adjusted for impedance matching, the radiation characteristics, such as directivity and gain, of the first loop electrode 21 are maintained. Further, transmission and reception of circularly polarized waves become possible by adjusting the arrangement of the open ends 22*a* and 22*b* of the first loop electrode 21.

Here, the fact that the first loop electrode 21 and the second loop electrode 25 are coupled to each other means that the two electrodes are electrically connected to each other through the coupling electrodes 27. The coupling is usually in the form of a DC direct connection, but the coupling may be magnetic coupling or electric field coupling, for example. Transmission and reception of circularly polarized waves become possible by setting the lengths of the line portions 12*c* and 12*d* to the same length (L11−L12=L21−L22). Further, good radiation characteristics are obtained by making the first and second loop electrodes 21 and 25 be respectively symmetrical or substantially symmetrical about the virtual straight line Y. In other words, in the first loop electrode 21, the voltage becomes maximum at the open ends 22*a* and 22*b* and the current becomes maximum along the virtual straight line Y. Similarly, in the second loop electrode 25, the current becomes maximum along the virtual straight line Y such that a high voltage can be applied between the feeding portions 15*a* and 15*b*.

In the antenna 10A, the first loop electrode 21 preferably is arranged so as to have an external shape that is square or substantially square. By making the external shape be a square or substantially square, a signal can be transmitted/received similarly in the vertical and horizontal directions (refer to arrows X1 and X2 in FIG. 1A) such that nearly non-directional transmission/reception is realized. Note that nearly non-directional transmission/reception may also be achieved when the first loop electrode 21 has an external shape of a circle or a regular polygon. The electrical lengths of portions of the first loop electrode 21 extending along the sides where the open ends 22*a* and 22*b* are provided are shorter than the lengths of the sides. This means that the first loop electrode 21 has a configuration in which the open ends 22*a* and 22*b* are provided. An area (null point) in which transmission/reception cannot be performed can be decreased by setting the electric lengths of the line portions 12*c* and 12*d* to be respectively longer than L12 and L22.

In the antenna 10A, it is preferable to make the electrical length of the first loop electrode 21 be about half of a wavelength λ used in transmission and reception, for example. This allows the resonant characteristics to be improved. Further, since the antenna 10A is non-directional and the first loop electrode 21 includes the plate electrode 12, a high-frequency signal is also transmitted from and received by the plate portion such that the gain is increased.

Second Preferred Embodiment

Figure 2:
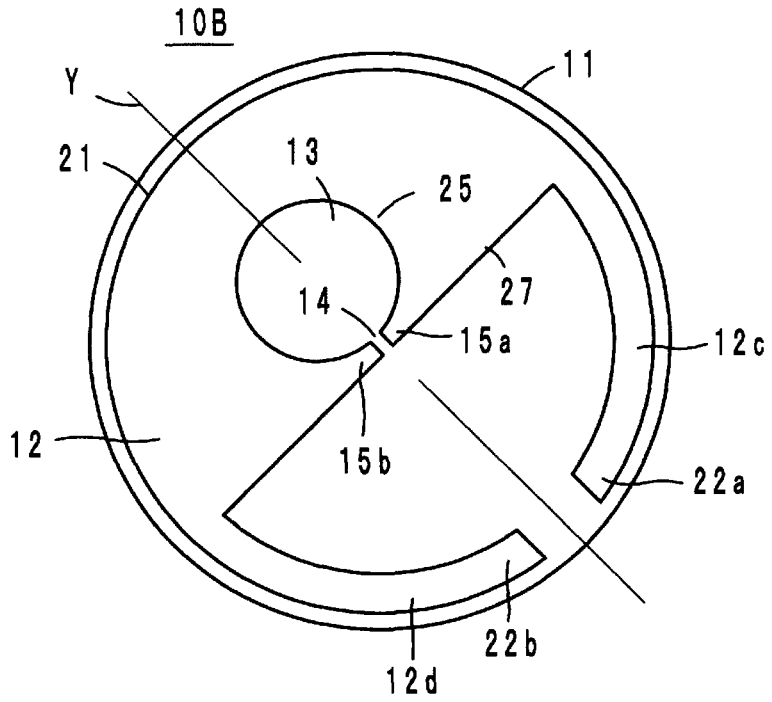
FIG. 2 is a plan view illustrating an antenna according to a second preferred embodiment of the present invention.

Referring to FIG. 2, an antenna 10B according to a second preferred embodiment has a configuration in which a plate electrode 12 preferably having a semicircular or substantially semicircular shape is located on the surface of a substrate 11 that is preferably circular or substantially circular. Line portions 12*c* and 12*d* extend from the two ends of the peripheral portion of the plate electrode 12 in such a manner as to form a concentric circle. A circular or substantially circular opening 13 and a slit portion 14 that communicates with the opening 13 are formed in the plate electrode 12. Opposing portions of the slit portion 14 define and function as feeding portions 15*a* and 15*b*.

In the second preferred embodiment, a first loop electrode 21 is arranged such that the peripheral portion and the line portions 12*c* and 12*d* of the plate electrode 12 define a circle. The tips of the line portions 12*c* and 12*d* are open ends 22*a* and 22*b*. A second loop electrode 25 is provided in a peripheral portion surrounding the opening 13 and the two ends thereof are connected to feeding portions 15*a* and 15*b*. Similarly to the first preferred embodiment, the wireless communication element 40 is coupled to the feeding portions 15*a* and 15*b*. Coupling electrodes 27 are located in the straight line portion of the plate electrode 12 and couples the first loop electrode 21 and the second loop electrode 25 to each other.

The operations of the first loop electrode 21, the second loop electrode 25, and the coupling electrodes 27 in the second preferred embodiment are similar to those of the first preferred embodiment described above, and the functions and the effects are also similar to those of the first preferred embodiment.

Third Preferred Embodiment

Figure 3:
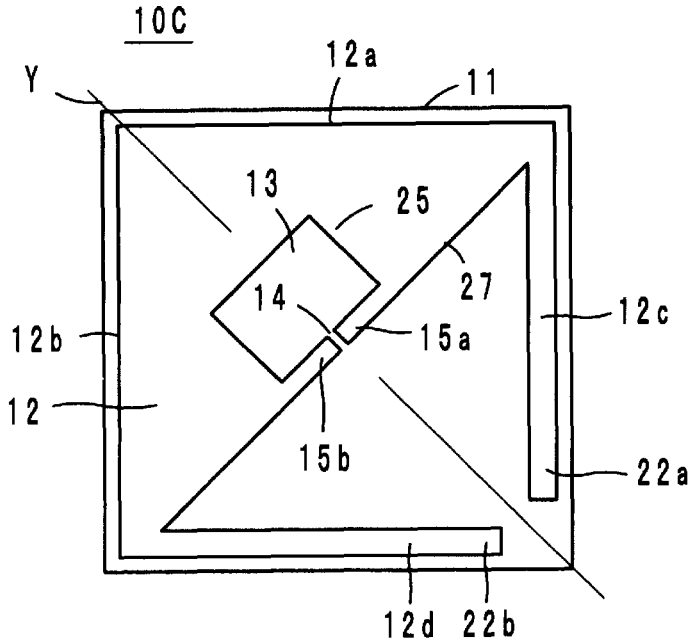
FIG. 3 is a plan view illustrating an antenna according to a third preferred embodiment of the present invention.

Referring to FIG. 3, an antenna 10C according to a third preferred embodiment has a configuration in which an opening 13 preferably is rectangular or substantially rectangular. The rest of the configuration and the functions and the effects are similar to those of the first preferred embodiment described above.

Fourth Preferred Embodiment

Figure 4:
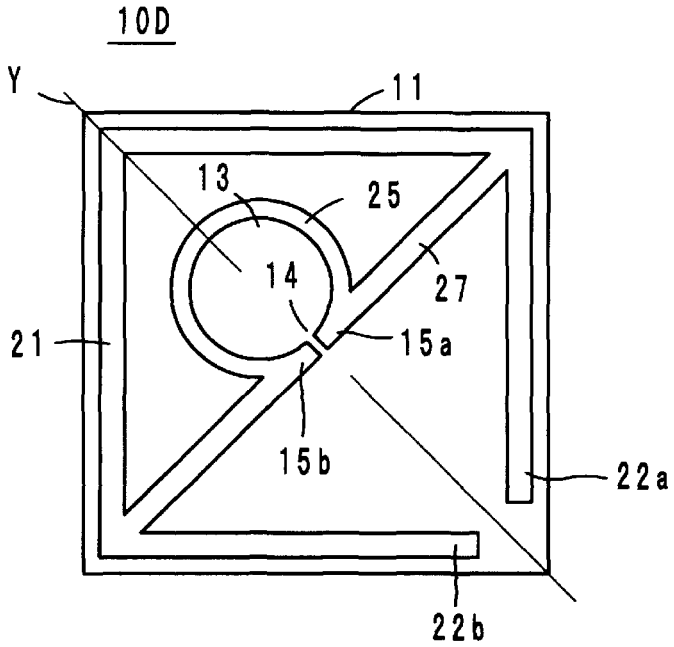
FIG. 4 is a plan view illustrating an antenna according to a fourth preferred embodiment of the present invention.

Referring to FIG. 4, an antenna 10D according to a fourth preferred embodiment has a configuration in which a first loop electrode 21, a second loop electrode 25, and coupling electrodes 27 are respectively defined by line conductors. The functions and effects of respective portions are similar to those of the first preferred embodiment described above.

Fifth Preferred Embodiment

Figure 5:
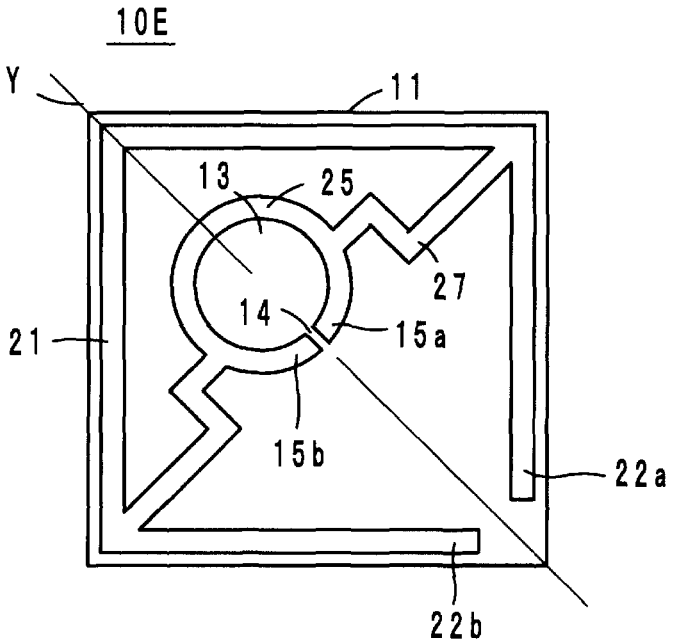
FIG. 5 is a plan view illustrating an antenna according to a fifth preferred embodiment of the present invention.

Referring to FIG. 5, an antenna 10E according to a fifth preferred embodiment has a configuration in which a first loop electrode 21, a second loop electrode 25, and coupling electrodes 27 are respectively defined by line conductors. The functions and effects of respective portions are similar to those of the first preferred embodiment described above. Specifically in the fifth preferred embodiment, the connection portions between the coupling electrodes 27 and the second loop electrode are arranged at positions that are spaced apart from the feeding portions 15*a* and 15*b*. By changing the positions of the connection portions between the coupling electrodes 27 and the second loop electrode 25 in this manner, impedance can be adjusted. Further, the degree of independence of the first loop electrode 21 and the second loop electrode 25 can be increased by increasing the lengths of the coupling electrodes 27.

Other Preferred Embodiments

Note that the antenna and wireless communication device according to the present invention are not limited to the preferred embodiments described above and can be modified in various ways within the scope of the present invention.

For example, although a wireless communication element in the form of a chip preferably is mounted on the feeding portions of an antenna in the preferred embodiments described above, by providing the wireless communication element on a substrate that is different from the substrate on which the loop electrode is provided, the wireless communication element may be connected to the feeding portions through connection paths such as flexible lines. Further, this antenna can be used not only as an antenna for an RFID tag but also as an antenna for a reader/writer or as an antenna for other communication systems, such as GSM and GPS, for example.

As described above, preferred embodiments of the present invention are useful for antennas and wireless communication devices, and specifically provide an advantage in that radiation characteristics are prevented from being changed as a result of impedance adjustment.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An antenna comprising:

a first loop electrode that has an external shape of a regular polygon or circle and that includes a pair of open ends;

feeding portions arranged inside the first loop electrode;

a second loop electrode connected to the feeding portions;

a coupling electrode that couples the first loop electrode and the second loop electrode to each other; and a plate electrode that includes an opening and a slit portion that communicates with the opening; wherein the coupling electrode and a portion of the first loop electrode are located in a peripheral portion of the plate electrode;

the second loop electrode is located in a peripheral portion surrounding the opening; and opposing portions of the slit portion define the feeding portions.

2. The antenna according to claim 1, wherein the feeding portions are arranged in a substantially central portion of the first loop electrode.

3. The antenna according to claim 1, wherein the first loop electrode and the second loop electrode have respective shapes that are symmetrical or substantially symmetrical about a virtual straight line passing through the open ends and the feeding portions.

4. The antenna according to claim 1, wherein the first loop electrode has an external shape that is square or substantially square.

5. The antenna according to claim 4, wherein an electrical length of a portion of the first loop electrode along a side where the open end is provided is shorter than a length of the side.

6. The antenna according to claim 1, further comprising a substrate that is square or substantially square, wherein the plate electrode is located on the plate and has an external shape that is triangular or substantially triangular.

7. The antenna according to claim 1, further comprising a substrate that is circular or substantially circular, wherein the plate electrode is located on the plate and has an external shape that is semicircular or substantially semicircular.

8. The antenna according to claim 1, wherein the opening has a shape that is circular or substantially circular.

9. The antenna according to claim 1, wherein the opening has a shape that is square or substantially square.

10. The antenna according to claim 1, wherein the opening has a shape that is rectangular or substantially rectangular.

11. The antenna according to claim 1, wherein an electrical length of the first loop electrode is about half of a wavelength of a signal received or transmitted by the antenna.

12. The antenna according to claim 1, wherein the first loop electrode and the second loop electrode are independent from each other such that adjustment of the second loop electrode does not affect the first loop electrode.

13. The antenna according to claim 1, wherein the first loop electrode, the second loop electrode, and the coupling electrode are respectively defined by line conductors.

14. The antenna according to claim 13, wherein a connection portion between the coupling electrode and the second loop electrode is located at a position that is spaced apart from the feeding portions.

15. An antenna comprising:

a first loop electrode that has an external shape of a regular polygon or circle and that includes a pair of open ends;

feeding portions arranged inside the first loop electrode;

a second loop electrode connected to the feeding portions;

a coupling electrode that couples the first loop electrode and the second loop electrode to each other; wherein the first loop electrode defines a radiation portion and the second loop electrode defines an impedance matching portion.

16. A wireless communication device comprising:

a first loop electrode that has an external shape of a regular polygon or circle and that includes a pair of open ends;

feeding portions arranged inside the first loop electrode;

a second loop electrode connected to the feeding portions;

a coupling electrode that couples the first loop electrode and the second loop electrode to each other;

a plate electrode that includes an opening and a slit portion that communicates with the opening; and a wireless communication element coupled to the feeding portions; wherein the coupling electrode and a portion of the first loop electrode are located in a peripheral portion of the plate electrode;

the second loop electrode is located in a peripheral portion surrounding the opening; and opposing portions of the slit portion define the feeding portions.

17. The wireless communication device according to claim 16, wherein the wireless communication element is mounted on the feeding portions.

18. The wireless communication device according to claim 16, wherein the wireless communication element is a chip component.

19. The wireless communication device according to claim 16, further comprising a substrate, wherein the wireless communication element is mounted on the substrate and connected to the feeding portions through connection paths.

* * * * *